US006361382B1

(12) United States Patent
Yamada et al.

(10) Patent No.: US 6,361,382 B1
(45) Date of Patent: Mar. 26, 2002

(54) TERMINAL ASSEMBLY PROVIDING A SPACE FOR INSERTING A CABLE

(75) Inventors: Akio Yamada; Takaharu Kouda, both of Tokyo; Manabu Hayakawa, Kariya, all of (JP)

(73) Assignees: DDK Ltd.; Denso Corporation, both of (JP)

( * ) Notice: Subject to any disclaimer, the term of this patent is extended or adjusted under 35 U.S.C. 154(b) by 0 days.

(21) Appl. No.: 09/691,673

(22) Filed: Oct. 18, 2000

(30) Foreign Application Priority Data

Oct. 18, 1999 (JP) ..... 11-295306

(51) Int. Cl.[7] ..... H01R 4/36
(52) U.S. Cl. ..... 439/813; 439/801
(58) Field of Search ..... 439/801, 813, 439/814, 815, 781, 782, 709, 718

(56) References Cited

U.S. PATENT DOCUMENTS 987,229 A * 3/1911 Haywood ..... 411/80.6
2,946,039 A * 7/1960 Grunwald et al. ..... 439/801
3,340,497 A * 9/1967 Balint ..... 439/872
3,783,921 A * 1/1974 Wagner ..... 151/41.7
4,077,691 A * 3/1978 Hagermo ..... 439/431
4,223,586 A * 9/1980 Miller ..... 85/63
5,458,512 A * 10/1995 Takano et al. ..... 439/801
5,580,286 A * 12/1996 Kramer et al. ..... 439/813
5,704,815 A * 1/1998 Shibata et al. ..... 439/709
6,053,742 A * 4/2000 Matsumoto et al. ..... 439/15

* cited by examiner

*Primary Examiner*—Brian Sircus
*Assistant Examiner*—Son V. Nguyen
(74) *Attorney, Agent, or Firm*—Baker Botts L.L.P.

(57) ABSTRACT

A terminal assembly includes a main block made of an electrically insulating material having a number of connection spaces for cables and contacts. The terminal assembly further includes contacts each having a connecting portion to be connected to a cable, a fixing portion to be fixed to the main block and a connection portion to be connected to a mating component. Each of the connection spaces includes a set screw having a washer inserted in the main block for electrically connecting and fixing the cable to the contact, and a nut inserted in the connection space for threadedly engaging the set screw having the washer. The main block is formed with set screw receiving apertures for the set screws. Each of the set screw receiving apertures is provided with at least one projection at a predetermined position on the inside of the set screw receiving aperture to provide a sufficient space for inserting the cable between the contact and the surface of the washer facing to the contact when the forward end of the set screw contacts the projection.

4 Claims, 3 Drawing Sheets

TERMINAL ASSEMBLY PROVIDING A SPACE FOR INSERTING A CABLE

BACKGROUND OF THE INVENTION

This invention relates to a terminal assembly for use in an industrial control system, particularly, a sequencer, and more particularly relates to a terminal assembly having improved positioning means for set screws with washers for connecting cables.

Terminal assemblies have been used, which include a main block made of an electrically insulating thermoplastic or thermosetting material such as a plastic material, contacts made of a conductive material such as a metal and press-fitted in the main block, cable insertion apertures for inserting the ends of conductive cables to be electrically connected to the contacts, and set screws with washers threadedly engaged in the main block for forcedly this bringing about the ends of the conductive cables into electrical contact with the contacts. After such a terminal assembly having the contacts press-fitted in its main block has been arranged at a predetermined position in a control system, the ends of predetermined conductive cables are inserted into the cable insertion apertures and then clamped and connected to the contacts by tightening the set screws with washers by means of a screwdriver or the like.

With such a hitherto used terminal assembly, however, before the assembly has been arranged at the predetermined position in the control system, the set screws with washers must be tightened to the full extent in order to avoid the set screws with washers from being dislodged from the terminal assembly. After arranged at the predetermined position, the set screws with washers are once loosened to provide sufficient spaces between the washers of the set screws and the contacts for inserting the ends of the conductive cables, and after the ends of the conductive cables have been inserted in the spaces, the set screws with washers are again tightened to finally connect the ends of the cables to the contacts.

Therefore, the operations loosening and secondarily tightening the set screws are needed which are tedious and time-consuming operations. Particularly, if insufficiently loosen the set screws in loosening operation, it will become difficult to insert cables into spaces between the washers and the contacts. On the other hand, if too loosen, there will be an increased risk of dislodgment of the set screws.

SUMMARY OF THE INVENTION

It is an object of the invention to provide an improved terminal assembly which eliminates the disadvantages of the prior art described above and which will be able to insure sufficient spaces between set screws and contacts for inserting ends of cables thereinto by means of improved positioning means for set screws, while preventing the set screws from being dislodged before the cables are connected to the terminal assembly without requiring any difficult operation.

In order to accomplish this object, in a terminal assembly including at least one contact having a connecting portion to be connected to a cable, a fixing portion to be fixed to a main block of said terminal assembly and a connection portion to be connected to a mating component; said main block made of an electrically insulating thermoplastic or thermosetting material for holding and fixing said contact and having at least one cable insertion aperture for said cable and at least one connection space for said contact and said cable; at least one set screw having a washer inserted in said main block for electrically connecting and fixing said cable to said contact; and at least one nut inserted in said main block for threadedly engaging said set screw having the washer; according to the invention at least one projection is provided at a predetermined position on the inside of a set screw receiving aperture formed in said main block for receiving said set screw to provide a sufficient space for inserting said cable between said contact and the surface of said washer facing to said contact when the forward end of said set screw contacts said projection.

The projection is preferably made of an elastic material such as rubber, other elastomers and elastic metals.

The projection may be formed integrally with the main block or may be formed separately from the main block and attached thereto with an adhesive.

The terminal assembly constructed as described above according to the invention can bring about the following significant effects over those of the prior art.

(1) According to the invention the main block of the terminal assembly comprises projections on the inner surfaces of the set screw receiving apertures so that the set screws can easily be positioned by bringing the ends of the set screws into contact with the projections when the terminal assembly is manufactured and shipped, while ensuring the sufficient spaces for inserting the ends of cables for their connection.

(2) With the terminal assembly according to the invention, as there are sufficient spaces between the contacts and the washers of the set screws for inserting the ends of cables to be connected when the terminal assembly has arrived at a customer, there is no need for loosening the set screws for connecting the cables by an operator of the customer, thereby enabling rapid connection operations to be performed with resulting reduction in cost and labor for manufacturing.

(3) The projections of the terminal assembly according to the invention have the elasticity to allow the repeated use of the terminal assembly connecting and disconnecting cables many times.

(4) The terminal assembly according to the invention is constructed to prevent the set screws with washers from being dislodged only by screwing them until contacting the projections, while only by screwing the set screws into the nuts by a screwdriver the projections are easily deformed to allow the set screws to advance, thereby enabling the ends of cables to be fixed to the contacts. As a result, the management of parts becomes easy.

The invention will be more fully understood by referring to the following detailed specification and claims taken in connection with the appended drawings.

DESCRIPTION OF THE PREFERRED EMBODIMENTS

Figure 1:
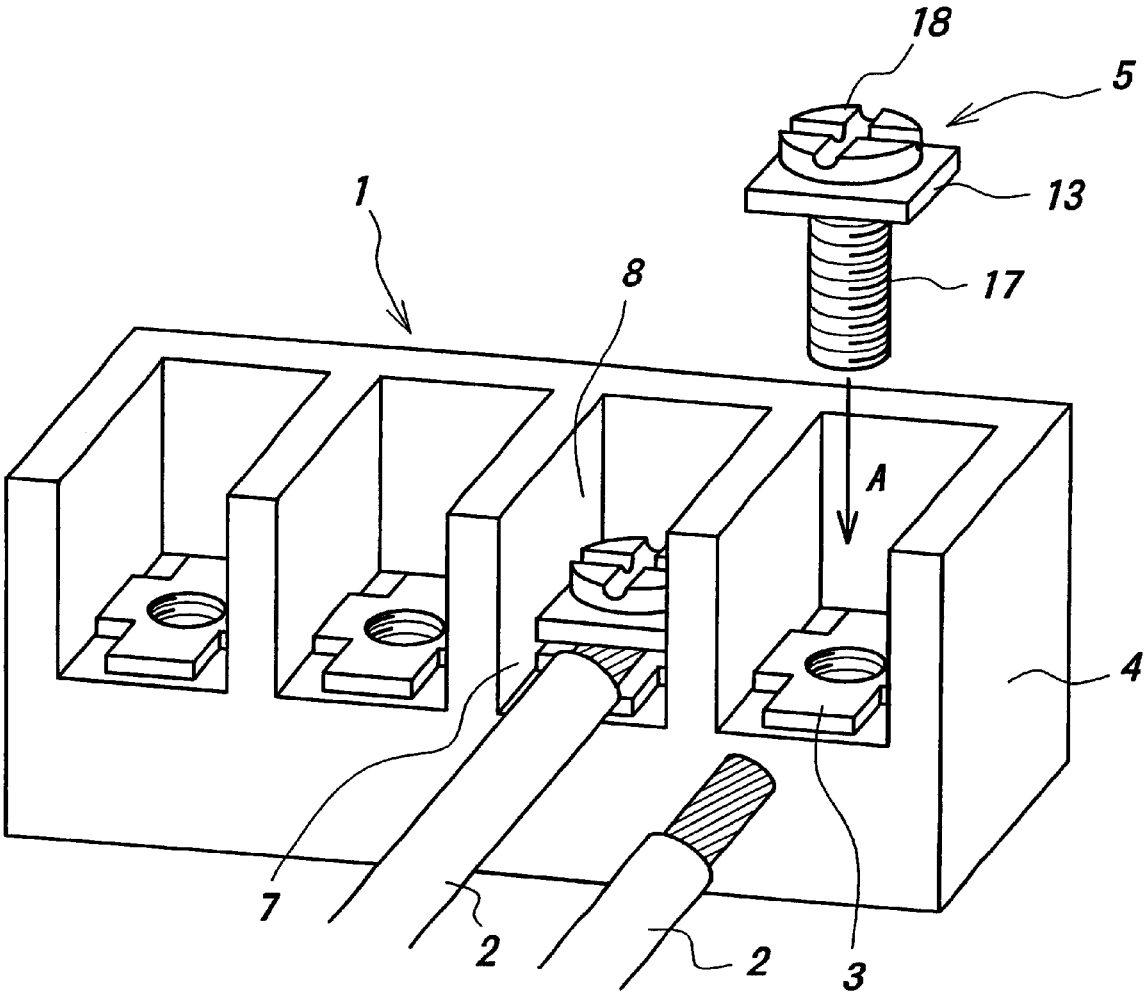
FIG. 1 is a perspective view of a terminal assembly showing a set screw with a washer and another set screw tightened to the assembly according to one embodiment of the invention.
Figure 2:
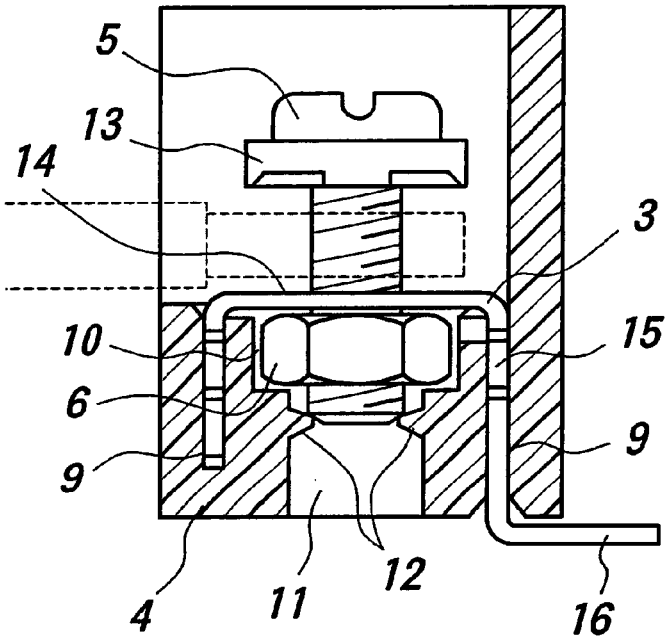
FIG. 2 and FIG. 4 are a longitudinal sectional view of the terminal assembly shown in FIG. 1.
Figure 3:
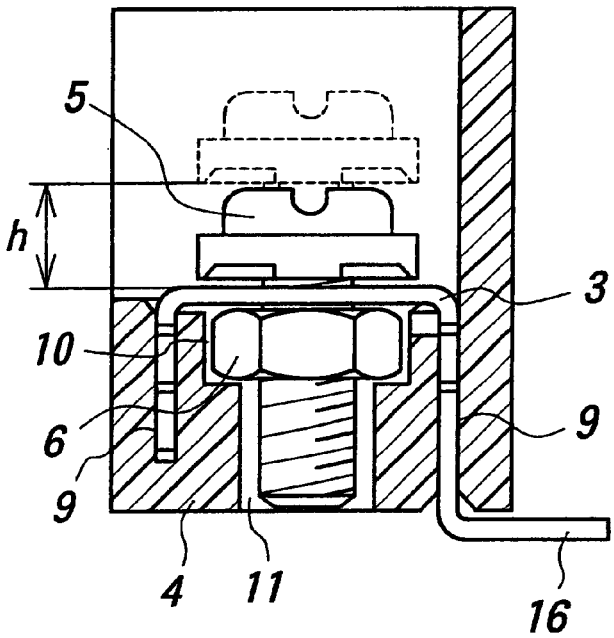
FIG. 3 PRIOR ART
FIG. 3 is a longitudinal sectional view of a terminal assembly of the prior art.
Figure 4:
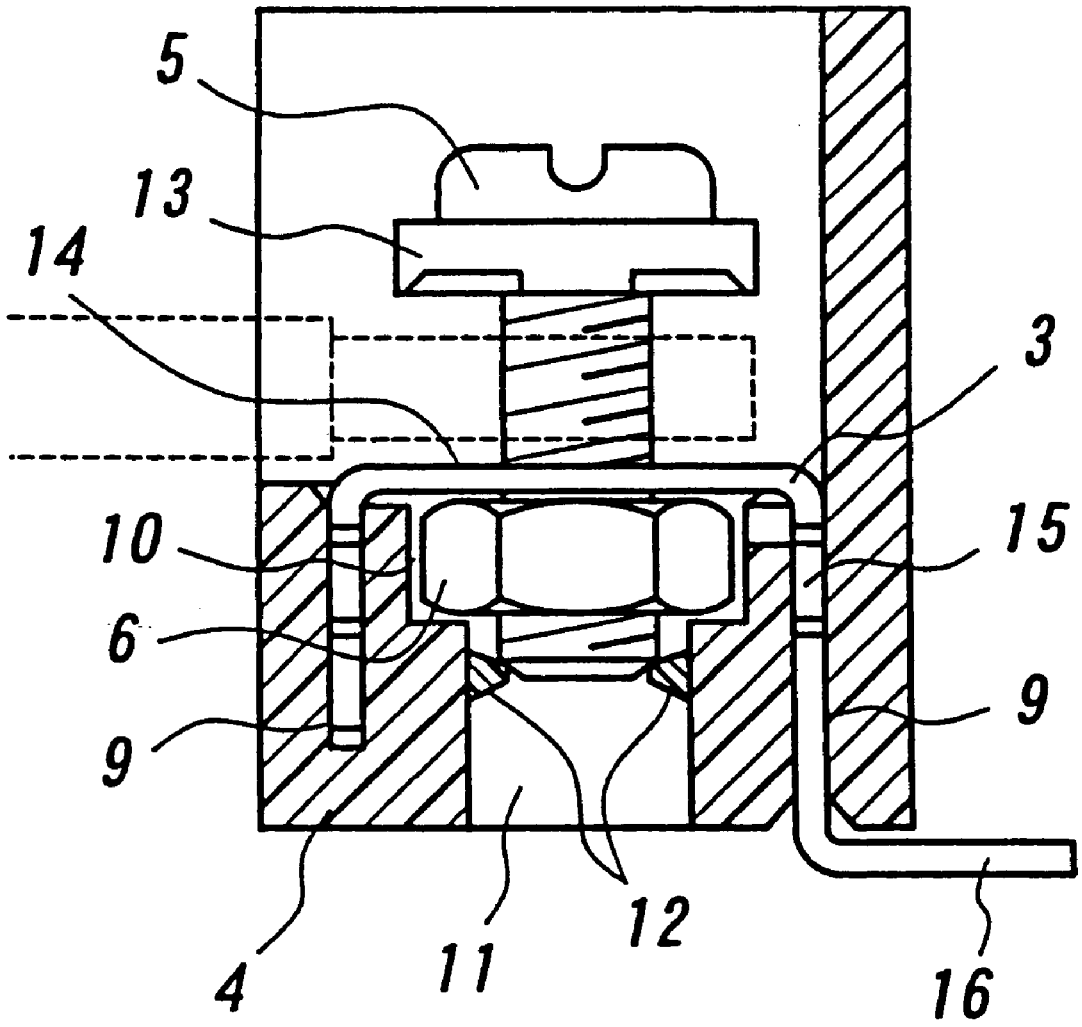

A terminal assembly of one embodiment according to the invention is shown in FIGS. 1 and 2. This terminal assembly 1 is composed of cables 2, contacts 3, a main block 4, set screws 5 with washers, and nuts 6. A cover (not shown) may be mounted on the main block 4 as the case may be. For the purpose of comparing with the present invention, FIG. 3 illustrates a terminal assembly of the prior art in a longitudinal sectional view in which like components are designated by the same reference numerals used in FIG. 1 and 2.

The main block 4 is made of an electrically insulating thermoplastic or thermosetting plastic material by known injection molding, such as polybutylene terephthalate (PBT), polyamide (PA), polycarbonate (PC) and the like which are relatively inexpensive and superior in moldability and dimensional stability. The main block 4 includes a required number of connection spaces 7 for connecting cables 2, respectively. In each of the connection spaces 7, there are provided a contact 3 as by press-fitting therein and the set screw 5 having a washer 13. The end of a cable 2 inserted in the terminal assembly 1 is embraced between the contact 3 and the set screw 5 having the washer 13 to complete the electrical connection between the terminal assembly 1 and the cable 2.

Between the set screws 5 having the washers 13 are provided partitions 8 to form the independent spaces therebetween, respectively. The connection spaces 7 and the partitions 8 may have any sizes so long as they can receive the set screws 5 having the washers 13 and the cables 2, but they are suitably designed in consideration of the whole size of the terminal assembly 1 and the strength of the main block 4. On the opposite side of the set screw 5, in each of the connection spaces 7 there are provided contact insertion apertures 9 for inserting the contact 3, and a nut insertion aperture 10 for receiving the nut 6 adapted to engage the set screw 5.

The contact insertion apertures 9 are substantially 0.05 to 0.15 mm larger than the contacts 3 themselves. The nut insertion apertures 10 have a shape matching the outer shape of the nuts 6 to prevent the nuts 6 from being rotated when the set screws 5 are being screwed into the nuts 6. The nut insertion apertures 10 have a size 0.5 to 0.8 mm larger than the nuts 6. Moreover, there are provided screw receiving apertures 11 continuous to the nut insertion apertures 9 for accommodating the ends of the set screws 5 when they have been fixed in the main block 4.

As shown in FIG. 2, the terminal assembly 1 according to the invention comprises a suitable numbers of projections 12 provided on the inside of each of the screw receiving apertures 11. The projections 12 may be made of the same material as and integrally formed with the main block 4, or may be made of a material different from that of the main block 4, which is an elastic material such as rubber, other elastomer or elastic metal and attached to the inside of the screw receiving apertures 11 by an adhesive. In either case, it is desired for the projections 12 to deform toward the inner wall of the aperture 11 when the set screw 5 with the washer 13 is being tightened. The projections 12 are so located that the end of the cable 2 can be inserted into the space between the contact 3 and the washer 13 of the screw 5 when the forward end of the set screw 5 contacts the projections 12.

The projections 12 extend inwardly to an extent such that an operator can feel a resistance of the projections 12 against the advancing set screw 5 when it is being screwed into the nut 6 for initially setting the set screw 5, and further the set screw 5 can advance to deform the projections 12 when the set screw 5 is being tightened for connecting the cable 2 to the terminal assembly 1. In this manner, the set screws 5 are screwed into the nuts 6 until the set screws 5 just touch the projections 12 when the manufactured terminal assembly 1 is shipped. After the terminal assembly has arrived at a customer, ends of cables are inserted between the washers 13 and the contacts 3 of the terminal assembly 1 and the set screws 5 are screwed into the nuts 6 until the ends of the set screws 5 advance beyond the projections 12, thereby tightly fixing the cables to the contacts. Preferably, the projections 12 have a shape which is of an inverted V-shaped cross-section or in the form of a ridge which is hard to be damaged, but is capable of deforming sufficiently owing to their elasticity to allow the set screws 5 to advance.

As shown in FIG. 1, the connection spaces 7 provided with the set screws 5 are arranged in alignment with each other in a row in the shown embodiment. However, they may be arranged in plural rows according to various applications.

The contacts 3 will be explained hereinafter. The contacts 3 are made of a metal as by the known press-working. Preferred materials from which to form the contacts 3 include brass, phosphor bronze, beryllium copper and the like which substantially comply with the imposed requirements for workability and springiness. The contact 3 consists of a connecting portion 14 adapted to be connected to the cable 2, a fixing portion 15 to be fixed to the main block 4, and a connection portion 16 to be electrically connected to a mating electrical component. The contacts 3 are press-fitted and fixed in the contact insertion apertures 9 of the main block 4. While the terminal assembly mounted on a board (surface mounting type) is illustrated in the embodiment as shown in FIG. 2, the invention may also be applicable to a terminal assembly attached to a board by soldering (dip type).

The set screws 5 with the washers 13 will then be explained. The set screw with washer is composed of the washer 13, an externally threaded shaft 17 and a screw head 18. The washer 13 is a separate member from the set screw 5, but is retained to the set screw 5 as by caulking for preventing it from being dislodged. The set screws 5 with washers 13 are inserted into the main block 4 in the direction shown by an arrow A in FIG. 1 so as to be fixed in the respectively independent connection spaces 7. The set screws 5 with washers are threadedly engaged in the nuts 6, respectively as shown in FIG. 2.

The nuts 6 will be finally explained herein. The nuts 6 are arranged in the nut insertion apertures 10, respectively, and are prevented from being dislodged therefrom by arranging the contacts 3 in the contact insertion apertures 9 formed in the main block 4. As shown in FIG. 3 illustrating the terminal assembly of the prior art, the forward end of the set screw 5 with the washer is clear of or spaced from the inside of the screw receiving aperture 11 of the main block 4. Consequently, the set screws 5 with washers of the terminal assembly of the prior art are unstable unless they are fully screwed into the nuts 6 into their lowermost positions when the manufactured terminal assembly is shipped to a customer. Moreover, when cables are connected to the terminal assembly by an operator of the customer, he must once loosen the set screws 5 so as to move the washers 13 sufficiently away from the contacts to insert the ends of cables between the washers 13 and the contacts 3, and thereafter the set screws 5 with washers are again tightened to clamp and fix the cables to the contacts 3.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A terminal assembly providing a space for inserting a cable, including at least one contact having a connecting portion to be connected to a cable, a fixing portion to be fixed to a main block of said terminal assembly and a connection portion to be connected to a mating component; said main block made of an electrically insulating thermoplastic or thermosetting material for holding and fixing said contact and having at least one connection space for said contact and said cable; at least one set screw having a washer inserted in said main block for electrically connecting and fixing said cable to said contact; and at least one nut inserted in a nut insertion aperture of said main block for threadedly engaging said set screw having the washer; and at least one screw receiving aperture formed in said main block continuous to said nut insertion aperture; wherein at least one projection is provided at a predetermined position on the inside of said set screw receiving aperture formed in said main block for receiving said set screw to provide a sufficient space for inserting said cable between said contact and the surface of said washer facing to said contact when the forward end of said set screw contacts said projection.

2. The terminal assembly as set forth in claim 1, wherein said projection is made of an elastic material selected from a group consisting of rubber, other elastomers and elastic metals.

3. The terminal assembly as set forth in claim 1, wherein said projection is formed integral with said main block.

4. The terminal assembly as set forth in claim 1, wherein said projection is formed separately from said main block and attached thereto with an adhesive.

* * * * *